US009498063B2

(12) United States Patent
Borgen

(10) Patent No.: US 9,498,063 B2
(45) Date of Patent: Nov. 22, 2016

(54) WINDOW SHELF

(71) Applicant: Karl Borgen, Germanton, NC (US)

(72) Inventor: Karl Borgen, Germanton, NC (US)

(73) Assignee: Karl Borgen, Germanton, NC (US)

( * ) Notice: Subject to any disclaimer, the term of this patent is extended or adjusted under 35 U.S.C. 154(b) by 0 days.

(21) Appl. No.: 14/451,604

(22) Filed: Aug. 5, 2014

(65) Prior Publication Data

US 2015/0250314 A1 Sep. 10, 2015

Related U.S. Application Data

(60) Provisional application No. 61/966,816, filed on Mar. 4, 2014.

(51) Int. Cl.

| | |
|---|---|
| ***A47B 5/00*** | (2006.01) |
| ***A47B 96/02*** | (2006.01) |
| ***A47H 27/00*** | (2006.01) |

(52) U.S. Cl.

CPC ..... *A47B 96/027* (2013.01); *A47H 27/00* (2013.01)

(58) Field of Classification Search

CPC ..... B60N 3/007; A47B 31/06; A47B 5/02; A47B 96/028; A47B 96/061; A47B 96/027; A47H 27/00; A47G 7/044

USPC ..... 108/42, 47, 152, 46

See application file for complete search history.

(56) References Cited

U.S. PATENT DOCUMENTS

| | | | | | |
|---|---|---|---|---|---|
| 1,224,127 | A | * | 5/1917 | Bartlett | 248/208 |
| 1,788,800 | A | * | 1/1931 | McGinley | 220/482 |
| 2,246,432 | A | * | 6/1941 | Cohen | 108/47 |
| 2,867,401 | A | * | 1/1959 | Sheahan | 248/231.41 |
| 3,125,040 | A | * | 3/1964 | Roberson | 108/18 |
| 4,057,031 | A | * | 11/1977 | Williams | A01K 1/0353 119/28.5 |
| 4,475,306 | A | | 10/1984 | Mehrens | |
| 4,653,712 | A | | 3/1987 | Murray et al. | |
| 4,897,958 | A | * | 2/1990 | Brydges | 47/68 |
| 5,020,756 | A | | 6/1991 | Bauer | |
| 5,964,497 | A | * | 10/1999 | Wiles | B60N 2/4666 296/153 |
| 6,237,799 | B1 | | 5/2001 | Emerson | |
| 6,540,093 | B1 | | 4/2003 | Shumway | |
| 6,796,249 | B1 | | 9/2004 | Hiras | |
| 8,016,135 | B2 | | 9/2011 | Price et al. | |
| 2005/0193625 | A1 | * | 9/2005 | Rosser et al. | 47/68 |
| 2010/0270251 | A1 | | 10/2010 | Mejac | |

* cited by examiner

*Primary Examiner* — Daniel J Troy
*Assistant Examiner* — Timothy M Ayres

(57) ABSTRACT

An apparatus is disclosed for a window shelf that attaches to a window stool without causing any damage and requiring no tools for installation. The apparatus includes a shelf with an upper and lower surface and a downwardly angled lip that engages with the rear portion of a window stool. A series of channels is defined by the bottom surface of the shelf and one or more plates, which receive one or more supporting legs. The horizontal surface of the supporting legs has a series of pointed teeth that engage with a series of pointed teeth along the channels, locking the shelf in place. The shelf can be used for a variety of purposes, such as holding household items, indoor planters, or even as a bed for small pets.

13 Claims, 7 Drawing Sheets

WINDOW SHELF

CROSS-REFERENCE TO RELATED APPLICATIONS

This application claims the benefit of U.S. Provisional Patent Application No. 61/966,816, filed Mar. 4, 2014, the entire contents of which are incorporated by reference herein.

TECHNOLOGICAL FIELD

Example embodiments of the present invention relate generally to a customizable shelf and, more particularly, to a shelf that connects to a window.

BACKGROUND

Most windows in homes today have very little associated shelf space. While it may be theoretically possible to place small objects on a window stool, these objects often obstruct blinds, curtains, window shades, or other objects placed on the small amount of space afforded by the size of the stool. Moreover, these objects are easy to accidentally displace, so there is a significant risk of accidentally damaging the objects, furniture, or the house itself. While there are shelves on the market that can be attached to a window, Applicant has identified many deficiencies associated with these shelves.

BRIEF SUMMARY

As noted above, traditional shelves that can be attached to a window present problems for most individuals. For instance, configuring the shelves often requires the use of tools, and attaching the shelving to a window can cause damage to the window, the window trim and/or the wall surrounding the window. Moreover, the actual process of attaching the shelves to windows or removing the shelves can be difficult for the average user. Example embodiments disclosed herein overcome these deficiencies and others. For instance, the embodiments disclosed below require no tools for installation, do not cause damage to the window, window trim, or the wall surrounding the window, and are easy to install and easy to remove by the average user.

In a first example embodiment, an apparatus is provided that includes a shelf that has an upper and lower surface and a downwardly angled lip that configured to hook over a window stool; a series of supporting legs that support the shelf from below and sit against the window stool, or the apron or wall below the window; and a series of channels on the lower surface of the shelf that receive the legs, securing the shelf to the window. The supporting legs have a horizontal surface and a vertical surface. The vertical surface can be flat while the horizontal surface features a series of pointed teeth. The channels contain a similar series of pointed teeth, which engage with the pointed teeth on the horizontal surface of the legs. When the pointed teeth on the horizontal surface of the legs engage with the pointed teeth in the channels, the shelf is locked into place.

In an example embodiment, the channels are defined by the lower surface of the shelf and one or more plates. The plates in the example embodiment are screwed to the lower surface of the shelf, but the plates may be completely integrated into the lower surface during the manufacturing process or connected using any other connectors.

The above summary is provided merely for purposes of summarizing some example embodiments to provide a basic understanding of some aspects of the invention. Accordingly, it will be appreciated that the above-described embodiments are merely examples and should not be construed to narrow the scope or spirit of the invention in any way. It will be appreciated that the scope of the invention encompasses many potential embodiments in addition to those here summarized, some of which will be further described below.

BRIEF DESCRIPTION OF THE DRAWINGS

Figure 1:
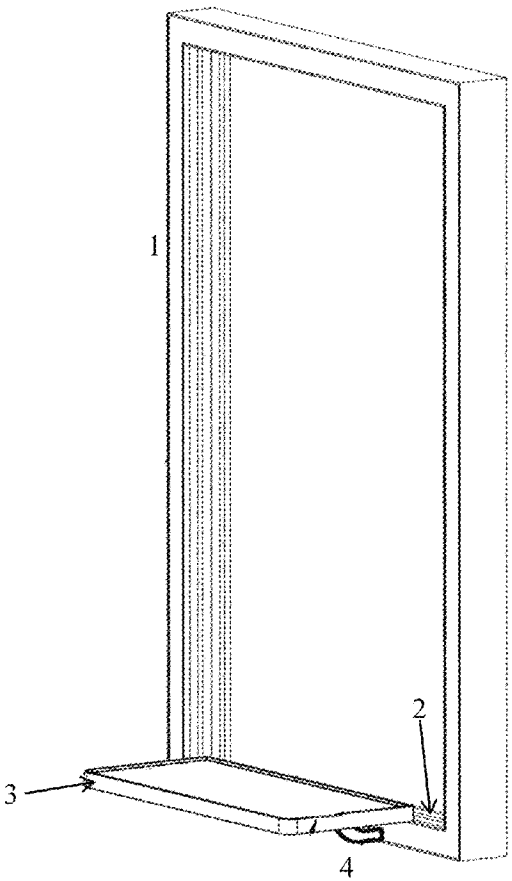
Figure 2:
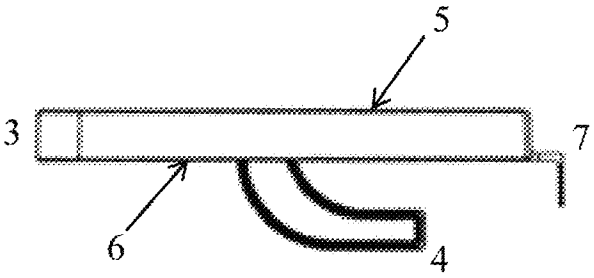
Figure 3:
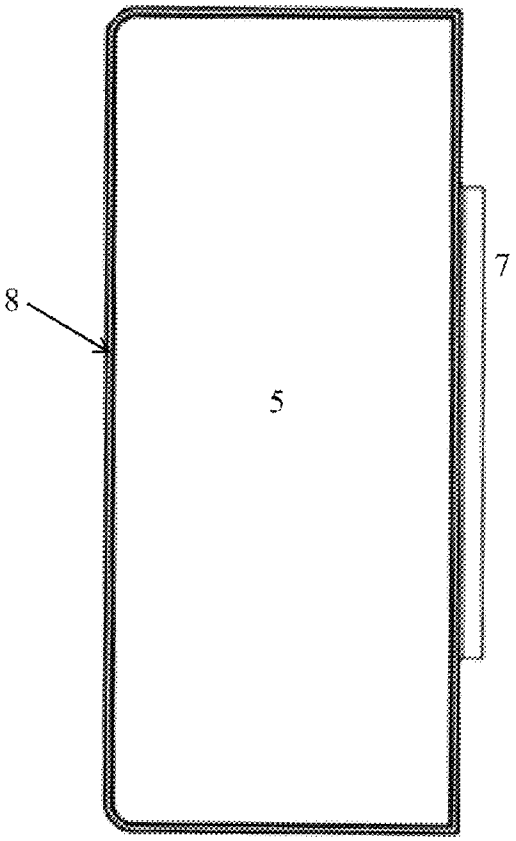
Figure 4:
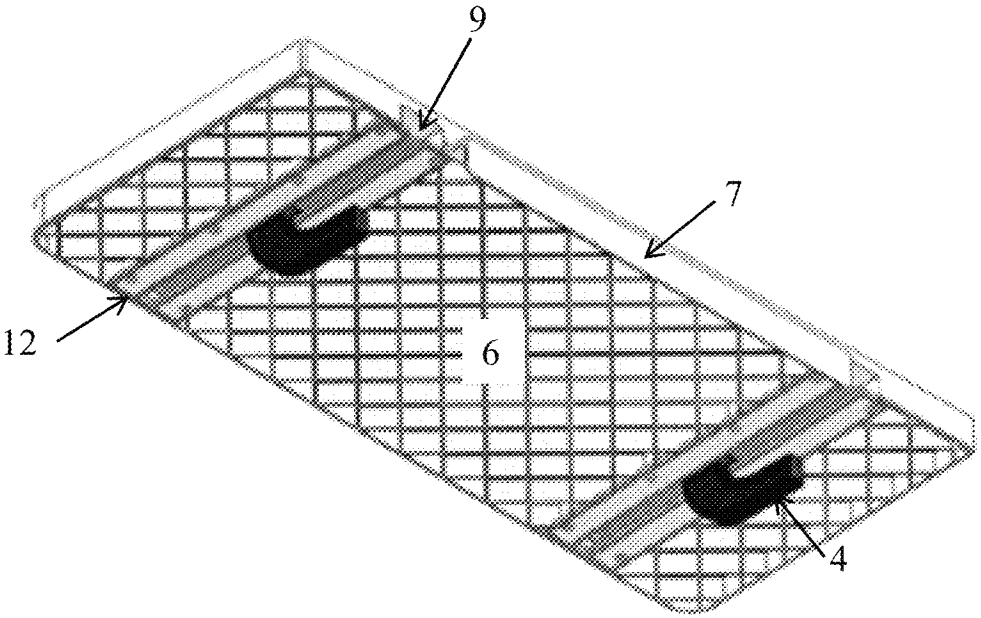
Figure 5:
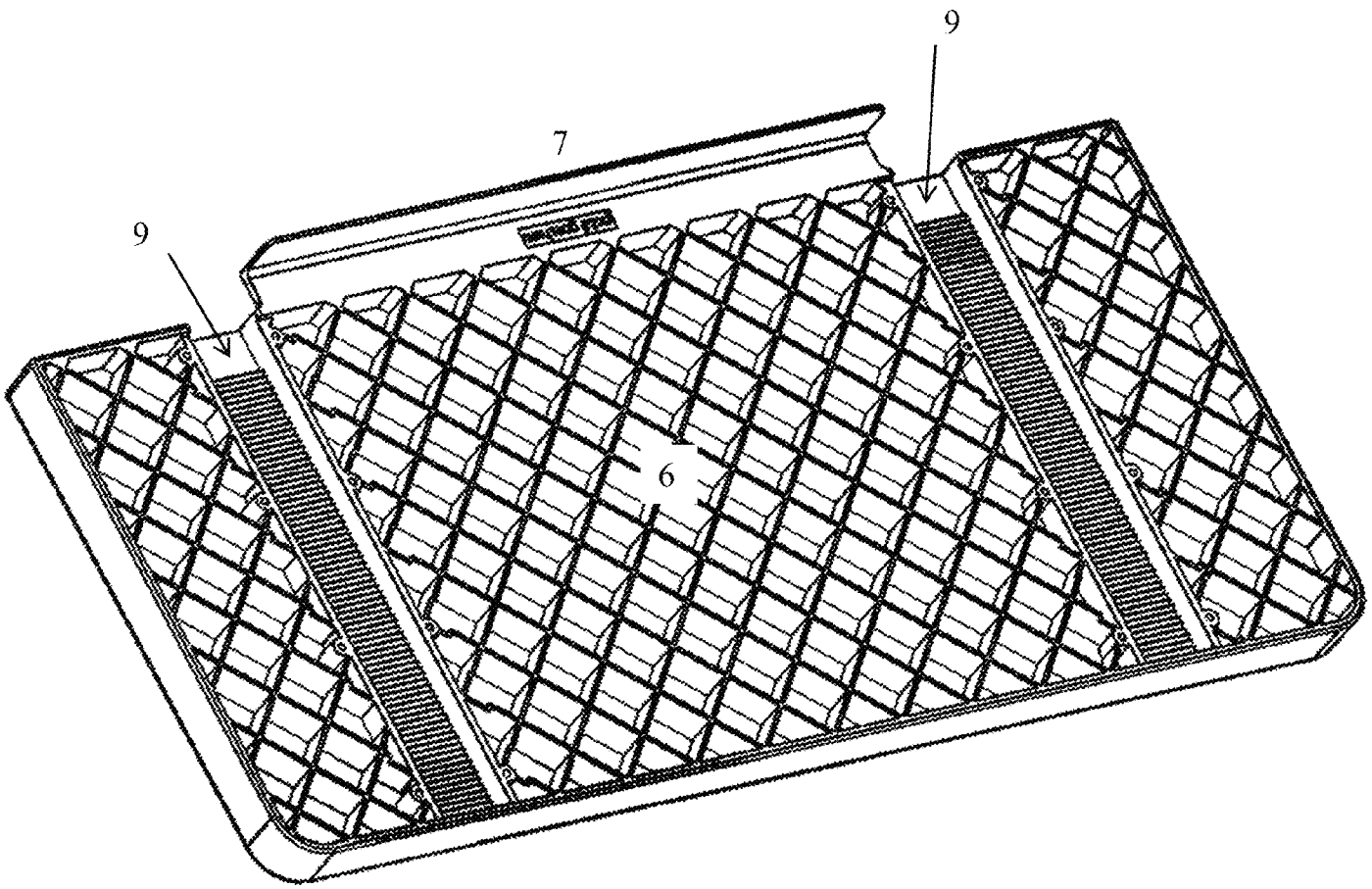
Figure 6:
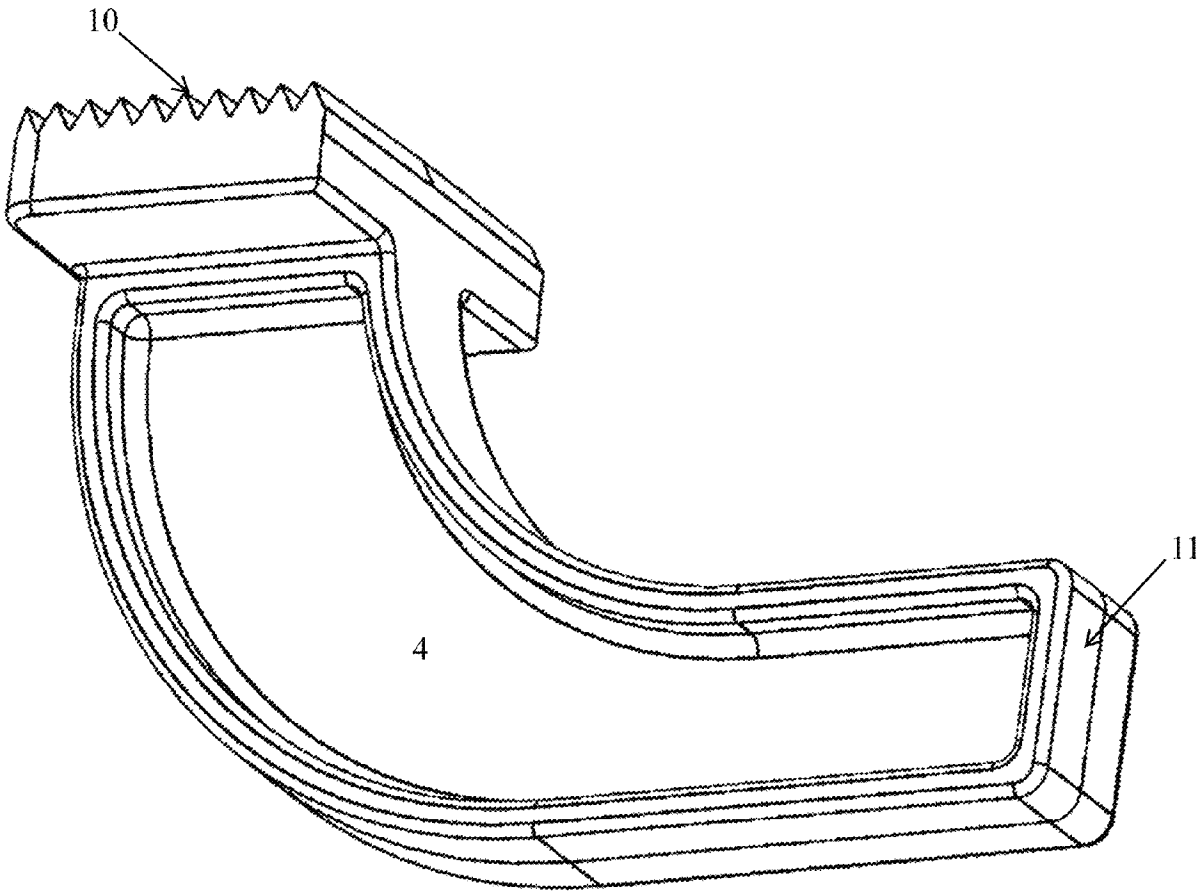
Figure 7:
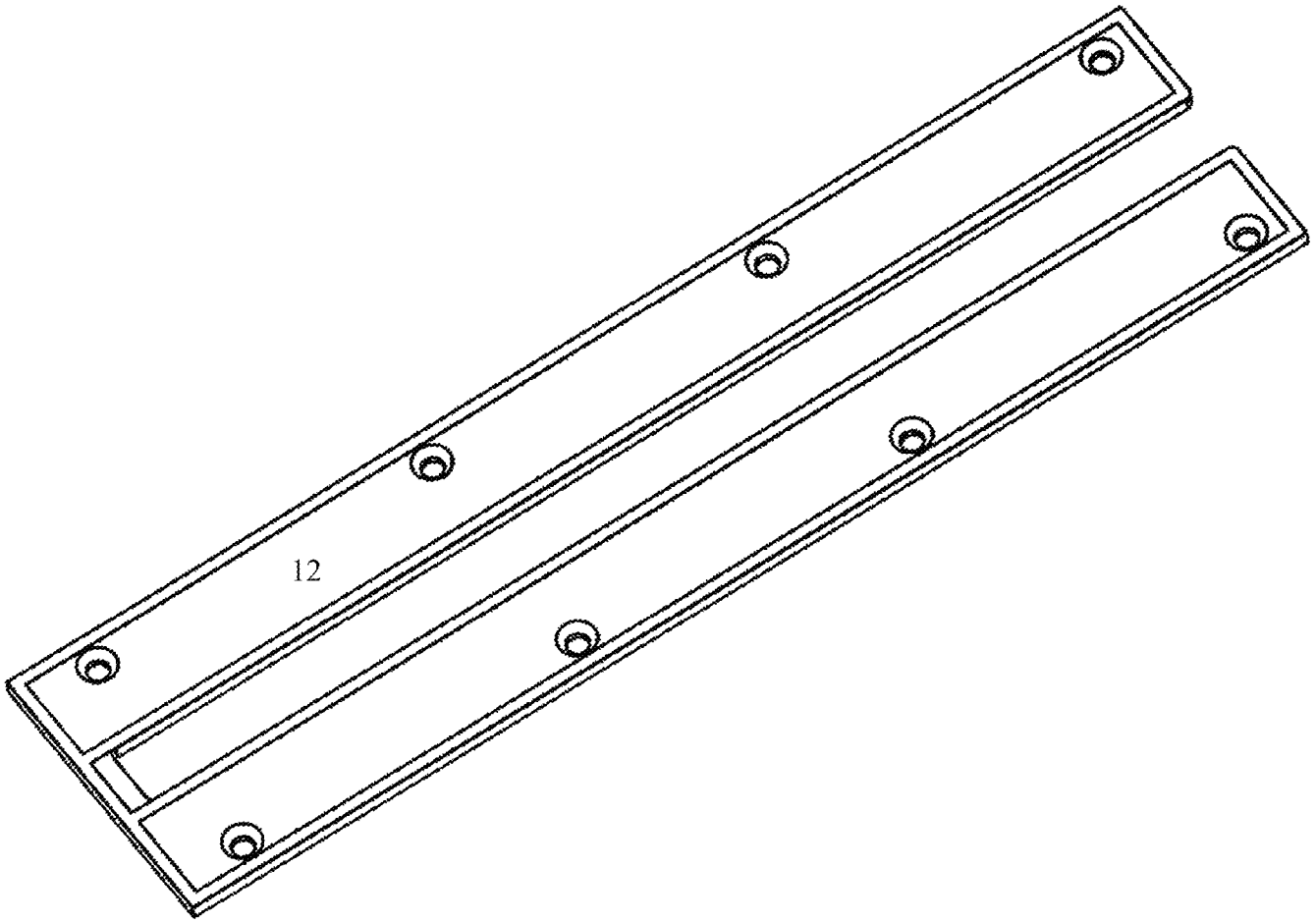

Having thus described certain example embodiments of the present disclosure in general terms, reference will now be made to the accompanying drawings, which are not necessarily drawn to scale, and wherein:

FIG. 1 illustrates an example shelf attached to a window, in accordance with an example embodiment of the present invention;

FIG. 2 illustrates a side view of the shelf including its supporting legs, in accordance with an example embodiment of the present invention;

FIG. 3 illustrates a top view of the shelf, in accordance with an example embodiment of the present invention;

FIG. 4 illustrates a perspective view, from below, of the shelf and its supporting legs, in accordance with an example embodiment of the present invention;

FIG. 5 illustrates a view of the bottom of a shelf without plates covering the channels, in accordance with an example embodiment of the present invention;

FIG. 6 illustrates a detailed view of a supporting leg, in accordance with an example embodiment of the present invention; and FIG. 7 illustrates a view of an example plate that covers the channel.

DETAILED DESCRIPTION

Some embodiments of the present invention will now be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Embodiments disclosed herein illustrate a shelf that can be secured to a window without the use of any tools and without requiring the addition of fasteners, such as screws, bolts, VELCRO® brand fasteners, glue, or the like. The shelf can be clamped against the window between a lip that hooks around a top portion of a window stool or vinyl window and one or more supporting legs that attach to the bottom of the shelf and press against a lower portion of the window stool, apron, or the wall beneath the window trim.

As described in greater detail below, the one or more supporting legs can connect securely to the shelf by sliding into one or more corresponding channels along the bottom surface of the shelf. These channels comprise one or more regions defined by the bottom surface of the shelf and one or more plates. In some embodiments, the one or more plates may be integrally formed with the shelf, while in others, the one or more plates may be secured to the shelf using fasteners (such as those described above).

The one or more supporting legs are configured to slide into the channels and can be secured against the shelf at various positions along the one or more channels. For instance, the length of the channels may include a series of pointed teeth, which can interlock with corresponding pointed teeth that are also present on the horizontal surface of the supporting legs. When the supporting legs slide into the channels, the two sets of pointed teeth engage each other, locking the shelf in place.

In an alternative embodiment, the supporting legs may be integrated into the shelf itself, such that they extend laterally in the same direction as the projecting portion. Such embodiments may be designed for standardized window stool sizes, and thus may further reduce the hassle of attaching and detaching the shelf to a window.

The supporting legs also have a vertical surface, which rests against the window stool, apron, or wall below the window. This vertical surface may be flat to lie flush against the wall, or may comprise a gripping portion that can firmly connect with a non-flat surface. The resulting shelf is easy to install, does not require any tools or connectors, and causes no damage to the window trim or wall.

Turning now to FIG. 1, an example shelf 3 is illustrated that is attached to a window. As shown in FIG. 1, the shelf 3 is designed to attach to the window stool 2 and extend horizontally away from the window stool 2. A supporting leg 4 is shown that supports the shelf 3 from below. Notably, although a single supporting leg 4 is illustrated in FIG. 1, embodiments disclosed herein may include one or more additional support legs 4 to further improve the degree of support provided to the shelf 3. The supporting legs 4 also engage either the lower portion of the window stool 2 or the apron or wall below the window stool 2, providing stability and strength. As shown in FIG. 2, the shelf 3 has a top surface 5 and a lower surface 6. The lower surface 6 includes a portion extending therefrom which includes a downwardly angled lip 7 configured to engage with an upper rear portion of a window stool 2. The lip 7 extends from the lower surface 6 of the shelf 3 and curves downwardly such that it is configured to hook around a rear portion of the window stool. The lip 7 and/or the extending portion of the lower surface 6 may comprise a hinged member, to enable a front side of the shelf 3 to be raised without causing movement of the lip 7 (and vice versa). In this manner, embodiments of the apparatus including this hinged member may prevent the lip 7 from biting into the rear portion of the window stool when the shelf is attached or detached. Moreover, in such embodiments, by folding the lip 7 and bending the hinge, the shelf may lie flush against a flat surface.

In some embodiments, the lip 7 may curve downwardly at a 90 degree angle. The downwardly curved portion of the lip 7 is preferably of a width that does not interfere with the ability of the window itself to open and close. The lip 7 is configured so it may be positioned over the upper rear edge of the window stool 2, preventing the shelf 3 from pulling away, horizontally, from the window. In combination with the one or more supporting legs 4, the lip 7 enables the window stool 2 to be clamped tightly, so the shelf remains firmly in place regardless of whether the window is open or closed.

As shown in FIG. 3, the shelf 3 may in some embodiments include a raised edge 8 that runs around the outside of its top surface 5, wherein the raised edge 8 is configured to prevent liquid or objects from sliding off of the top surface 5 of the shelf 3.

Turning now to FIG. 4, a perspective view from the bottom of the assembled shelf 3 is disclosed. The supporting legs 4 are configured to engage the lower surface 6 of the shelf 3 within a series of channels 9, as shown in FIG. 4. The supporting legs 4 support the weight of the shelf and its contents. The supporting legs 4 do not have to be connected to the window stool 2 or the wall surrounding the window using any fasteners. The supporting legs 4 can be moved horizontally along the length of the channels 9 to adjust to any size window stool. The channels 9 are covered by plates 12 that in some embodiments may be permanently connected to the lower surface 6 of the shelf 3, or may be created as an integral part of the lower surface 6 of the shelf 3 during the manufacturing process. In other embodiments, such as that shown in FIGS. 5 and 8, the plates 12 can be connected to the lower surface 6 using a fastener, thereby allowing the plates to be removed at a later time.

FIG. 5 shows a view of the lower surface 6 of the shelf 3 and provides a detailed view of the channels 9. Each channel 9 has a series of pointed teeth along its length.

The supporting legs 4 have a horizontal surface 10 and a vertical surface 11, as shown in FIG. 6. In some embodiments, the vertical surface 11 rests flush against the apron or wall below the window or against the window stool 2. In other embodiments, the vertical surface 11 may comprise a gripping portion for contacting a corrugated or slippery surface. The horizontal surface 10 has a series of pointed teeth, which engage with the pointed teeth within the channels 9 on the lower surface 6 of the shelf 3. When the pointed teeth of the horizontal surface 10 engage with the pointed teeth of a channel 9, the supporting leg 4 is rendered immobile, and the shelf 3 remains secured to the window stool 2 without any connectors, thus avoiding damage to the walls and window trim. This mode of connection allows for installation without any tools and easy removal.

As mentioned above, in an alternative embodiment the supporting legs 4 may be integrated into the lower surface 6 of the shelf 3. In such an embodiment, the supporting legs 4 extend laterally in the same direction as the projecting portion a predetermined distance that accords with standard dimensions of a household window stool.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. Although specific terms are employed herein, they are used in a generic and descriptive sense only and not for purposes of limitation.

What is claimed is:

1. An apparatus comprising:

a shelf having an upper surface and a lower surface;

a portion extending laterally away from the lower surface of the shelf, the portion extending laterally away from the lower surface of the shelf including a downwardly angled lip configured to engage with a rear portion of a window stool, wherein the shelf and the portion including the downwardly angled lip are integrally molded as one piece;

one or more channels defined by the lower surface of the shelf and one or more corresponding plates, wherein each of the one or more corresponding plates is coextensive in length with the one or more channels, wherein each of the one or more corresponding plates has a length that is coextensive with the lower surface of the shelf, and wherein at least one of the channels has a series of pointed teeth along its length; and one or more detachable supporting legs disposed in the one or more channels, each of the one or more detachable support legs having a horizontal surface for engaging the lower surface of the shelf, the horizontal surface having a series of pointed teeth, wherein a vertical dimension of the at least one of the channels provides clearance between the series of pointed teeth of the at least one channel and the series of pointed teeth of a corresponding detachable supporting leg sufficient to enable movement of the corresponding detachable supporting leg along the length of the channels.

2. The apparatus of claim 1, wherein each of the one or more detachable supporting legs has a vertical surface for engaging the wall below a window stool.

3. The apparatus of claim 2, wherein the vertical surface is flat.

4. The apparatus of claim 2, wherein the vertical surface comprises a gripping portion.

5. The apparatus of claim 1, wherein the one or more corresponding plates are integrally formed with the shelf.

6. The apparatus of claim 1, wherein the one or more corresponding plates are fastened to the bottom surface of the shelf.

7. The apparatus of claim 1, wherein the upper surface of the shelf has a raised outer edge along its perimeter.

8. An apparatus comprising:

a shelf having an upper surface and a lower surface;

a portion extending laterally away from the lower surface of the shelf, the portion extending laterally away from the lower surface of the shelf including a downwardly angled lip configured to engage with a rear portion of a window stool, wherein the shelf and the portion including the downwardly angled lip are integrally molded as one piece;

one or more channels defined by the lower surface of the shelf and one or more corresponding plates, wherein each of the one or more corresponding plates has a length that is coextensive with the lower surface of the shelf; and one or more supporting legs disposed in the one or more channels.

9. The apparatus of claim 8, wherein each of the one or more supporting legs has a vertical surface for engaging the wall below a window stool.

10. The apparatus of claim 9, wherein the vertical surface is flat.

11. The apparatus of claim 9, wherein the vertical surface comprises a gripping portion.

12. The apparatus of claim 8, wherein the one or more supporting legs comprise two supporting legs.

13. The apparatus of claim 8, where the upper surface of the shelf has a raised outer edge along its perimeter.

* * * * *